US006427951B1

(12) United States Patent
Ortiz Rivas

(10) Patent No.: US 6,427,951 B1
(45) Date of Patent: Aug. 6, 2002

(54) ADJUSTING SYSTEM FOR RAILROAD TURNOUT SWITCH POINTS

(76) Inventor: Arturo A. Ortiz Rivas, Manuel Doblado 235 Nte. Centre, Monterrey, N.L. (MX)

( * ) Notice: Subject to any disclaimer, the term of this patent is extended or adjusted under 35 U.S.C. 154(b) by 0 days.

(21) Appl. No.: 09/812,126

(22) Filed: Mar. 19, 2001

(51) Int. Cl.[7] ..... E01B 7/00
(52) U.S. Cl. ..... 246/450
(58) Field of Search ..... 246/415 R, 435 R, 246/448, 449, 450, 451, 452

(56) References Cited

U.S. PATENT DOCUMENTS

| | | | | |
|---|---|---|---|---|
| 664,617 A | | 12/1900 | Barry | |
| 690,421 A | * | 1/1902 | Green | 246/450 |
| 825,172 A | | 7/1906 | Angerer | |
| 862,645 A | | 8/1907 | Lewis | |
| 900,750 A | * | 10/1908 | Lewis | 246/450 |
| 912,621 A | | 2/1909 | Reinnoehl | |
| 934,213 A | | 9/1909 | Price | |
| 940,441 A | | 11/1909 | Dotter | |
| 1,072,866 A | | 9/1913 | McEvoy | |
| 1,335,385 A | | 3/1920 | Mitchell | |
| 1,459,001 A | * | 6/1923 | Strong | 246/450 |
| 1,507,491 A | * | 9/1924 | Larry | 246/450 |
| 1,517,398 A | * | 12/1924 | Brumage | 246/450 |
| 1,637,919 A | * | 8/1927 | Sampson | 246/450 |
| 1,671,738 A | * | 5/1928 | O'Brien | 246/450 |
| 1,765,856 A | | 6/1930 | Werthmann | |
| 2,060,448 A | * | 11/1936 | Schwendt et al. | 246/448 |
| 5,393,019 A | | 2/1995 | Ortiz-Rivas | |
| 5,456,430 A | | 10/1995 | Ortiz-Rivas | |
| 6,119,988 A | | 9/2000 | Ortiz-Rivas | |

OTHER PUBLICATIONS

Railway Track & Structures, Nov. 1992, pp. 27–29.
Railway Track & Structures, Mar. 1996, pp. 34–35.
American Railway Engineering Association, Plan No. 8–79, sheet 2, Mar. 1979.
American Railway Engineering Assoication, Plan No. 251–64, Mar. 1964.
L.B. Foster Company, Catalog Sheets IV–33, 34, 35, 39, 1999 or earlier.

* cited by examiner

*Primary Examiner*—Mark T. Le
(74) *Attorney, Agent, or Firm*—Bracewell & Patterson L.L.P.

(57) ABSTRACT

Switch points for a railroad turnout have an adjustable connecting rod member which moves the switch points to the desired direction. The adjustable connecting rod member is easily adjustable to provide proper alignment of the switch points with the stock rails with minimal effort and without the need for specialized crews. There is also no need to disconnect the adjustable connecting rod member from the switch points during adjustment.

21 Claims, 3 Drawing Sheets

ADJUSTING SYSTEM FOR RAILROAD TURNOUT SWITCH POINTS

BACKGROUND OF INVENTION

1. Field of Invention

The present invention relates to adjustable bar for switch points for railroad turnouts.

2. Description of the Prior Art

In railroad tracks, turnouts or switches are used to change the direction of rail traffic from one set of rails to another. Switch stands are provided to change the position of switch points in the turnout or switch. The switch points change position and cause rail traffic to either continue on its present set of rails (often called the stock rails) or to be transferred to a new set of rails. The switch stand has an operator mechanism to change the position of the switch points as desired.

A connecting rod is the part of the turnout that connects the switch stand to the switch points. The turnout includes at least one connecting rod, but more may be included in a switch.

The connecting rods of a turnout work as connecting elements and adjustment parts in order to keep the switch points in engagement with the stock rail. When the stock points are not correctly supported at the stock rail, the possibility of a derailment becomes a serious risk. Any misalignment or misadjustment of the switch points is thus a potentially serious problem. Misalignment or misadjustment can occur from several causes, such as extreme temperatures, lateral movement of the stock rail or the like. Due to the importance of having the switch points properly aligned and adjusted over their service life, railroads have used specialized personnel and crews for such purposes. This in turn has resulted in increased operating costs.

So far as is known, the present techniques for accurately adjusting the connecting rods to the switch points are difficult, takes considerable time and requires specialized personnel. Further, so far as is known, the adjustment mechanisms permitted adjustment of only one at a time of the two rails in a rail pair for a turnout or switch. Further, in order to perform such an adjustment, it was necessary to disconnect the adjusting mechanism from the other parts of the switch.

SUMMARY OF INVENTION

Briefly, the present invention provides a new and improved aligning system in a railroad track turnout or switch. According to the present invention, alignment and proper engagement of the switch points with the rails in the railroad switch may be performed quickly and without disconnecting the adjustment mechanism from the other parts of the switch.

With the present invention, the adjusting system the switch includes a first switch point connector and a second switch point connector, each of which is brought into contact with an associated one of the rails in the switch. An adjustment member which is operable in response to a switch mechanism in the switch is connected at opposite end portions to the first and second switch point connectors. First and second rotatable couplings are connected at opposite end portions oft he adjustment member between the adjustment member and the rotatable couplings. The first and second rotatable couplings are each independently movable while the first and second switch point connectors are attached to their respective switch points.

With the rotatable couplings being independently movable, the relative position of the switch points with their respective rails in the switch may be adjusted to achieve desired engagement for safety purposes and for increased service life of the switch. This alignment and adjustment is achievable without disconnecting the adjustment mechanism from the other parts of the switch. Further, the rotatable couplings may be adjusted independently of each other, and only one need be adjusted, if required.

A lock mechanism is provided to secure the rotatable couplings against inadvertent movement of the parts of the adjustment mechanism. The lock mechanism also is releasable to allow movement of the rotatable couplings with respect to the switch point connector for alignment and adjustment purposes. Also, if the switch requires, more than one adjustment mechanism may be provided.

DESCRIPTION OF THE PREFERRED EMBODIMENT

Figure 1:
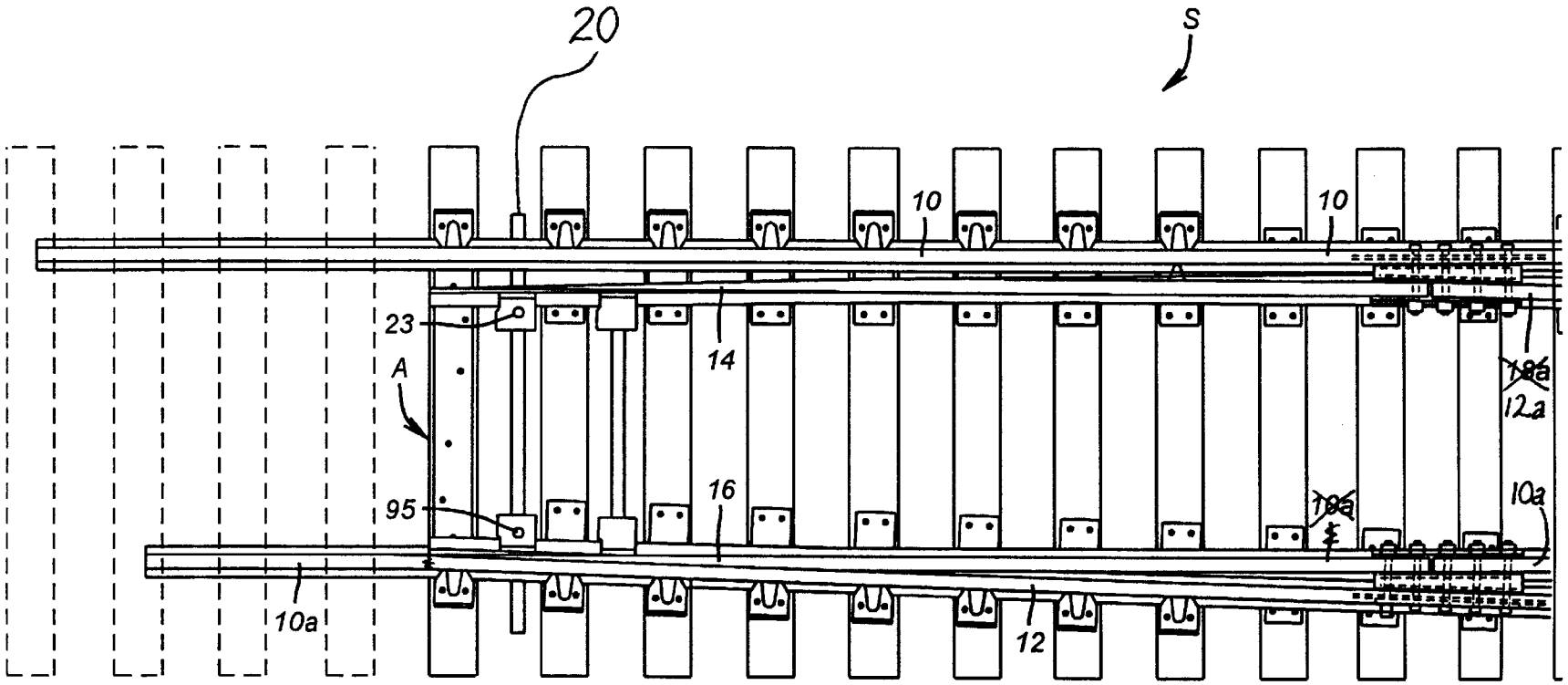
FIG. 1 is a plan view of a railroad switch having an adjusting system according to the present invention.
Figure 2:
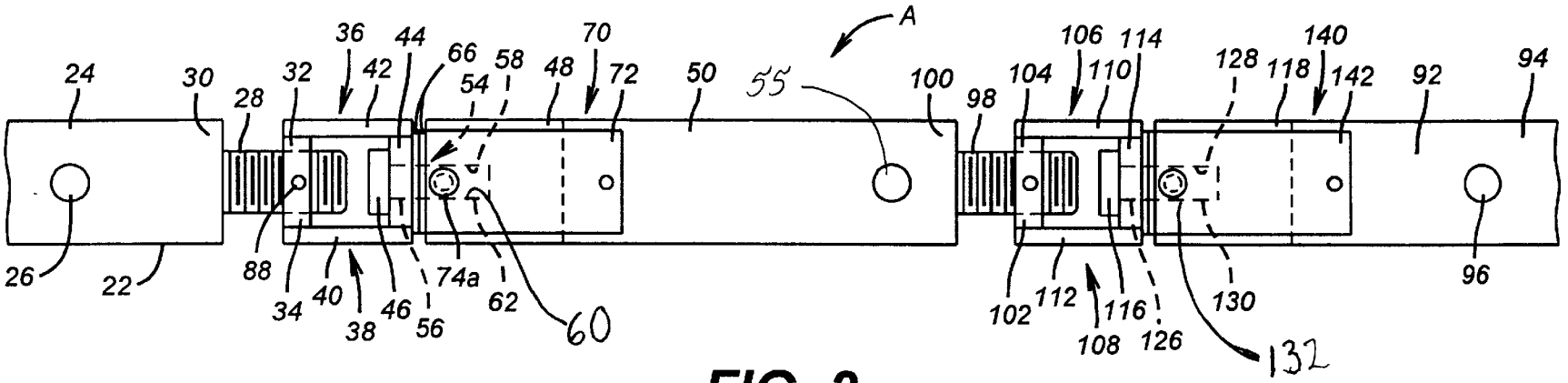
FIG. 2 is a plan view of an adjusting bar of the adjusting system of FIG. 1 in an unlocked position.
Figure 3:
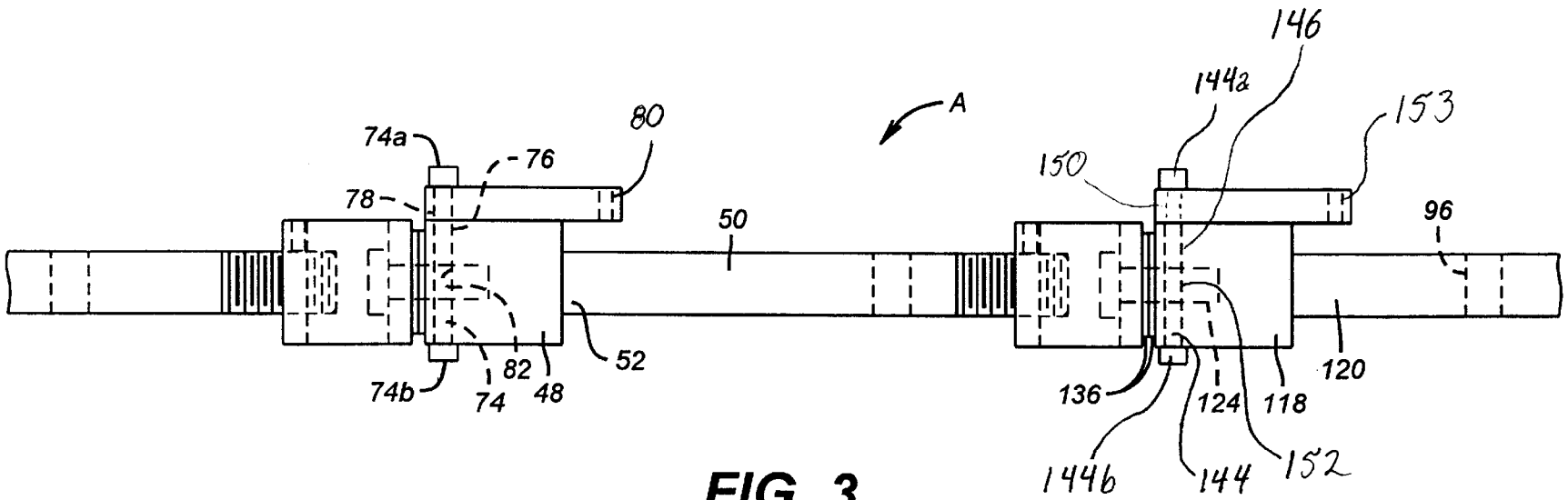
FIG. 3 is a side elevation view of the adjusting bar of FIG. 2.

In the drawings, the letter S (FIG. 1) designates generally a railroad switch or turnout having first rails 10 and second rails 12 which are engageable, that is capable of being selectively contacted by movement into engagement, respectively, with a first adjustable switch point 14 and second adjustable switch point 16. Each of the rails 10 and 12 forms an associated rail pair with an appropriately spaced rail 10*a* and 12*a*, respectively.

A switch mechanism of the conventional type shown schematically at 20 causes the switch point 14 and 16 to move from a first position shown in the drawings where the switch points 14 is out of engagement with rail 10 and switch point 16 is in contact with rail 12 to an alternate or thrown position where the switch points 14 is in engagement with the rail 10 and switch point 16 is out of contact with rail 12. Depending upon the position of the switch points 14 and 16, rail traffic thus may then be diverted between the original rail pair 10 and 10*a* onto the other set or pair of rails 12 and 12*a*.

According to the present invention, the switch S includes an adjusting switching A (FIGS. 1–5) which insures that the switch points 14 and 16 are properly aligned for engagement with rails 10 and 12, as the case may be, when the switch S is in its alternate positions. As will be set forth below, the adjusting system A allows periodic adjustment of the relative position for spacing of the switch points 14 and 16 so that proper alignment and engagement with the rails 10 and 12 is maintained. Further, during such adjustment, it is not necessary to disconnect or otherwise the adjusting system A from either the switch S or the switch points 14 and 16.

Considering the adjusting system A more in detail (FIGS. 2–5), a first switch point connector or connector bar 22 is attached in the manner of a conventional switch and to the first switch point 14 at a first end 24 with a conventional bolt, pin or other standard fastener mechanism 23 (FIG. 1) which is inserted through the threaded connector socket 26 (FIGS. 2–5). The first switch point connector 22 and other components of the adjusting system S are preferably formed of a suitable strength and durability steel material.

A threaded connector pin 28 is formed extending outwardly at a second or opposite end 30 of the switch point connector 22 spaced from the connector socket 26. The connector pin 28 is mounted in a threaded inner sleeve 32 formed in an end plate 34 of a box-shaped first rotatable coupling 36. The end plate 34 is a component of a first housing 38 having side walls 40 and 42 extending from opposite ends oft he end plate 34 to an end connector plate 44. The end connector plate 44 of rotatable coupling 36 is rotatably mounted by a connector bolt 46 to a connector box, 48 of an adjustment member or bar 50 at an outer end 52.

The connector bolt 46 has a shaft 54 passing for free rotational movement through a passage 56 in the end connector plate 44 of the first nut housing 38. The connector bolt 46 has a threaded surface 58 formed on an outer end 60 of its shaft 54. The threaded surface 58 of the connector bolt 46 is connected in a threaded socket 62 of the connector box 48 on adjustment member 50.

The mounting of connector bolt 46 with nut housing 38 allows the rotatable coupling 36 to be freely rotatable with respect to the adjustment member 50. Typically, one or more washers 66 are mounted on the shaft 54 of the connector bolt 46 between the nut housing 38 and the adjustment member 50.

A lock mechanism 70 is provided with an outer end of the adjusting system A to retain, once properly adjusted, the desired spacing between the switch point connector 22 and the adjustment member 50. The lock mechanism 70 includes a lock cover plate 72 rotatably mounted on the connector box 48 of the adjustment member 50. The lock cover plate 72 is formed of a similar material to other components of the adjusting system A and is connected by a connector pin or bolt 74 to the connector box 48.

Figure 4:
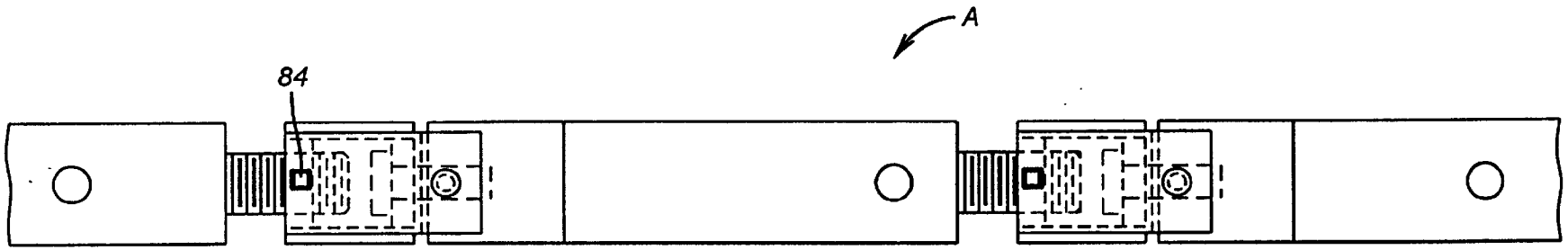
FIG. 4 is a plan view of an adjusting bar of the adjusting system of FIG. 1 in a locked position.
Figure 5:
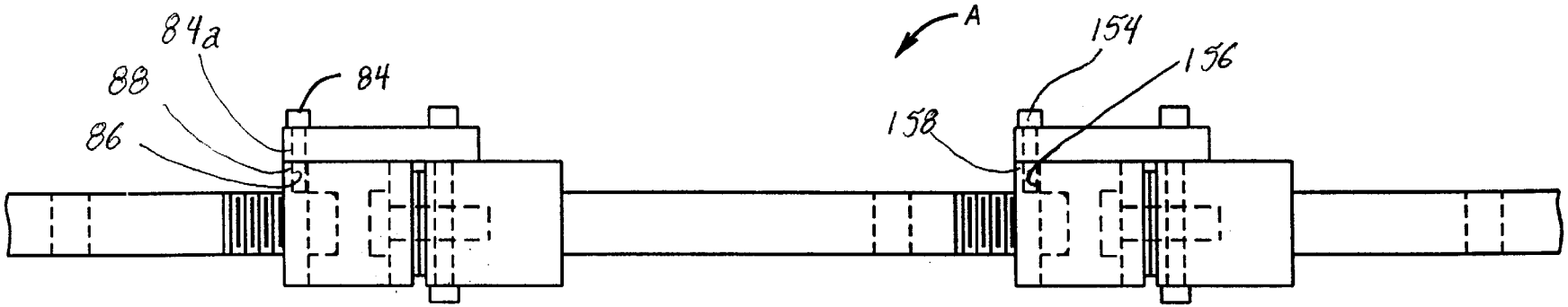
FIG. 5 is a side elevation view of the adjusting bar of FIG. 4.

The connector plate 72 is rotatably mounted to the connector box 48 by a connector pin, 74 passing through a mounting passage 76 formed in the connector box 48. The lock cover plate 72 is movable from an open position (FIGS. 2 and 3) to a locked position (FIGS. 4 and 5). A connecting pin slot or passage 78 is formed in the lock cover plate 72 opposite the mounting passage 76. The connecting pin 74 is inserted through the passage 78 and extends through such passage between head portions 74*a* and 74*b*. The connector pin 74 also passes through an internal opening 82 in the connector box 48 and the shaft 54 in the connector bolt 46.

The locking plate 72 has a connector pin socket 80 at an opposite end from the passage 78 to allow insertion of a lock connector pin 84 (FIGS. 4 & 5). The lock connector pin 84 has a, threaded surface 84*a* matching the threaded surface 86 (FIGS. 2 & 3) formed in a counter bored passage 88 formed extending into the end plate 34 of the nut housing 38. The lock connector pin 84 when connected (FIGS. 4 & 5) into the counter bored passage 88 locks the lock plate 72 against relative movement and retains the lock plate in the position shown in FIGS. 4 and 5.

In this position, the lock connector pin 84 engages connector pin 28 to prevent relative rotational movement of the rotatable coupling 36 with respect to the switch plate connector 26. The connector pin 84 also through the locking plate 72 interconnects the rotatable coupling 36 and connector box 48 to lock these two structural elements together against relative rotational movement. The lock mechanism 70 when connected thus restricts relative movement of the switch point connector 22 and the adjustment member 50.

A receptor socket 55 is formed at a suitable central portion oft he adjustment member 50 for engagement by a bar, rod or lever so that the adjustment member 50 may be rotated. The locking mechanism 70 must be in an unlocked position for this to occur. Because of the threaded connection of the end plate 34 with the connector pin 28, rotation of coupling 36 with respect to connecting pin 28 causes the relative spacing of the switch point connector 22 with respect to the adjustment member 50 to be selectively adjustable. Depending on the direction of rotation of the coupling 36, the relative spacing oft he switch point connector 22 and the adjustment member 50 may be increased or decreased to insure that the switch point 14 is maintained firmly in contact with the rail 10 at required times during the service life of the switch S.

A second switch point or connector bar 92 is attached in the manner of a conventional switch rod to the second switch point 16 at an inner end 94 with a conventional bolt or pin 95 (FIG. 1) or other suitable fastener mechanism through a threaded connector 96. A threaded connector pin 98 is formed extending outwardly at a second or opposite end 100 of the adjustment member 50 for the second switch point 16 spaced from the outer end 52. The connector pin 98 is mounted in a threaded inner sleeve 102 formed in an end plate 104 of a second rotatable coupling 106. The end plate 104 is a component of a box-shaped second housing 108 have side walls 110 and 112 extending from opposite ends of the end plate 104 to an end connector plate 114. The end connector plate 114 of rotatable coupling 106 is rotatably mounted by a connector bolt 46 to a connector box 118 mounted on an outer end 120 of switch point bar 122 from inner end 94.

The connector bolt 116 has a shaft 124 passing for free rotational movement through a passage 126 in the end connector plate 114 of the second nut housing 108. The connector bolt 116 has a threaded surface 128 formed on an outer end 130 of its shaft 124. The threaded surface 128 of the connector bolt 116 is connected in a threaded socket 132 of the connector box 118 on second switch point bar 92.

The mounting of connector bolt 116 with nut housing 108 allows the rotatable coupling 106 to be freely rotatable with respect to the second switch point bar 92. Typically, one or more washers 136 are mounted on the shaft 124 oft he connector bolt 116 between the nut housing 108 and the second switch point bar 92.

A lock mechanism 140 is provided with an inner end of the adjusting system A to retain, once properly adjusted, the desired spacing between the switch point connector 92 and the adjustment member 50. The lock mechanism 140 is operable independently of the other lock mechanism 70 of the adjusting system A. The lock mechanism 140 includes a lock cover plate 142 rotatably mounted on the connector box 118 of the second switch point bar 92. The lock cover plate 142 is formed of a similar material to other components of the adjusting system A and is connected by a connector pin or bolt 144 to the connector box 118.

The connector plate 142 is rotatably mounted to the connector box 118 by a connector pin 144 passing through a mounting passage 146 formed in the connector box 118. The lock cover plate 144 is movable from an open position (FIGS. 2 and 3) to a locked position (FIGS. 4 and 5). A connecting pin slot or passage 150 is formed in the lock cover plate 142 opposite the mounting passage 146. The connecting pin 144 is inserted through the passage 150 and extends through such passage between head portions 144*a* and 144*b*. The connector pin 144 also passes through an internal opening 152 in the connector box 118 and the shaft 124 in the connector bolt 116.

The locking plate 142 has a connector pin socket 153 at an opposite end from the passage 150 to allow insertion of a lock connector pin 154 (FIGS. 4 & 5). The lock connector pin 154 has a threaded surface matching the threaded surface 156 (FIGS. 2 & 3) formed in a counter bore passage 158 formed extending into the end plate 104 of the nut housing 108. The lock connector pin 154 when inserted into the counter bored passage 158 locks the lock plate 140 against relative movement and retains the lock plate 140 in the position shown in FIGS. 4 and 5. In this position, the connector pin 154 engages connecting pin 98 to prevent relative rotational movement of the rotatable coupling 106 with respect to the adjustment member 50. The connector pin 154 also through the locking plate 142 interconnects the rotatable coupling 106 and connector box 118 to lock these two structural elements together against relative rotational movement. The lock mechanism 140 when connected thus restricts relative movement of the switch point connector 92 and the adjustment member 50.

When it is desired to adjust the position of the second rotatable coupling 106, the lock mechanism 140 is unlocked. As has been noted, this can be done independently of the lock mechanism 70. Thus, with the present invention, adjustment of the position of the first rotatable coupling 36 and the second rotatable coupling 106 maybe performed independently of each other. Further, the adjusting system A remains connected in the switch S during adjustment of either or both of such rotatable couplings. Because of the threaded connection of the end plate 104 with the connector pin 98, rotation of coupling 106 with respect to connecting pin 98 causes the relative spacing of the switch point connector 92 with respect to the adjustment member 50 to be selectively adjustable. Depending on the direction of rotation of the coupling 106, the relative spacing of the switch point connector 92 and the adjustment member 50 may be increased or decreased to insure that the switch point 16 is maintained firmly in contact with the rail 12 at required times during the service life of the switch S.

As has been noted, the adjusting system A of the switch S may be used to move the switch points 14 and 16 independently of each other and without disconnection of the adjusting system A from the switch. Further, the adjustment may be performed with common available implements, such as a wrench to unlock and lock the locking mechanisms 70 and 140, and a rod, bar or lever to engage the adjustment member 50 through opening 55.

The foregoing disclosure and description oft he invention are illustrative and explanatory thereof, and various changes in the size, shape, materials, and components, as well as in the details oft he illustrated structure and construction and method of operation may be made without departing from the spirit of the invention.

What is claimed is:

1. An adjusting system for aligning switch points with rails in a railroad track switch, comprising:

a first switch point connector attached to a first switch point which is engageable with a first rail in the switch;

a second switch point connector attached to a second switch point which is engageable with a second rail in the switch;

an adjustment member operable in response to a switch mechanism of the switch;

a first rotatable coupling connected between a first end portion of the adjustment member and to the first switch point connector;

a first connector member rotatably attaching the first rotatable coupling to the adjustment member and allowing rotation of the first rotatable coupling about the first switch point connector without rotation of the first connector member relative to the adjustment member;

a second rotatable coupling connected between a second end portion of the adjustment member and the second switch point connector;

a second connector member rotatably attaching the second rotatable coupling to the second switch point connector and allowing rotation of the second rotatable coupling about the adjustment member without rotation of the second connector member relative to the second switch point connector;

said first and second rotatable couplings being each independently movable while the first and second switch point connectors are attached to their respective switch points to adjust their relative position and align the first and second switch points for proper contact with their respective rails.

2. The adjusting system of claim 1, further including:

a lock mechanism for securing the first rotatable coupling.

3. The adjusting system of claim 1, further including:

a lock mechanism for securing the second rotatable coupling.

4. The adjusting system of claim 1, including:

a threaded connector pin formed on the first switch point connector at a position spaced from the attachment to the first switch point.

5. The adjusting system of claim 4, wherein the first rotatable coupling comprises:

a housing rotatably mounted on the threaded connector of the first switch point connector.

6. The adjusting system of claim 5, further including a threaded socket formed in the housing of the first rotatable coupling for receiving the threaded connector of the first switch point.

7. The adjusting system of claim 6, further including a locking pin for securing the housing of the first rotatable coupling to the threaded connector pin of the first switch point.

8. The adjusting system of claim 5, wherein:

the first a connector member rotatably attaches the housing of the first rotatable coupling to the adjustment member.

9. The adjusting system of claim 8, further including a lock mechanism for securing the first rotatable coupling relative to the adjustment member, further allowing the housing of first rotatable coupling to rotate about the threaded connector pin of the first switch point connector.

10. The adjusting system of claim 9, wherein the lock mechanism comprises:

a locking plate mounted with the adjustment member.

11. The adjusting system of claim 10, wherein the locking plate is releasably attachable to the first rotatable coupling.

12. The adjusting system of claim 11, further including a locking pin for attaching the locking plate to the first rotatable coupling.

13. The adjusting system of claim 1, including:

a threaded connector pin formed on the adjustment member for connection to the second rotatable coupling.

14. The adjusting system of claim 13, wherein the second rotatable coupling comprises:

a housing rotatably mounted on the threaded connector of the adjustment member.

15. The adjusting system of claim 14, further including a threaded socket formed in the housing to the second rotatable coupling for receiving the threaded connector of the adjustment member.

16. The adjusting system of claim 14, wherein:

the second connector member rotatably attaches the housing on the threaded connector of the adjustment member to the second rotatable coupling.

17. The adjusting system of claim 16, further including a lock mechanism for securing the second rotatable coupling relative to the second switch point connector, further allowing the housing to rotate about the threaded connector pin of the adjustment member.

18. The adjusting system of claim 17, wherein the lock mechanism comprises:

a locking plate mounted with the second switch point.

19. The adjusting system of claim 18, wherein the locking plate is releasably attachable to the adjustment member.

20. The adjusting system of claim 19, further including a locking pin for attaching the locking plate to the first rotatable coupling.

21. A railroad switch, comprising:

first and second rails;

first and second adjustable switch points;

a switch mechanism causing the first and second switch points to move into and out of engagement with the first and second rails; and an adjusting system for aligning the first and second adjustable switch points in engagement with the first and second rails, comprising:

a first switch point connector attached to a first switch point which is engageable with a first rail in the switch;

a second switch point connector attached to a second switch point which is engageable with a second rail in the switch;

an adjustment member operable in response to a switch mechanism of the switch, a first rotatable coupling connected between a first end portion of the adjustment member and the first switch point connector;

a first connector member rotatably attaching the first rotatable coupling to the adjustment member and allowing rotation of the first rotatable coupling about the first switch point connector without rotation of the first connector member relative to the adjustment member;

a second rotatable coupling connected between a second end portion of the adjustment member and the second switch point connector;

a second connector member rotatably attaching the second rotatable coupling to the second switch point connector and allowing rotation of the second rotatable coupling about the adjustment member without rotation of the second connector member relative to the second switch point connector;

said first and second rotatable couplings being each independently movable while the first and second switch point connectors are attached to their respective switch points to adjust their relative position and align the first and second switch points for proper contact with their respective rails.

* * * * *